United States Patent [19]

Brühmann et al.

[11] 4,281,630

[45] Aug. 4, 1981

[54] CENTRIFUGAL RPM GOVERNOR FOR INTERNAL COMBUSTION ENGINES

[75] Inventors: Werner Brühmann; Reinhard Schwartz, both of Stuttgart; Darsten Hummel, Wendlingen, all of Fed. Rep. of Germany

[73] Assignee: Robert Bosch GmbH, Stuttgart, Fed. Rep. of Germany

[21] Appl. No.: 59,356

[22] Filed: Jul. 20, 1979

[30] Foreign Application Priority Data

Sep. 2, 1978 [DE] Fed. Rep. of Germany ..... 2838367

[51] Int. Cl.[3] ..... F02D 1/04

[52] U.S. Cl. ..... 123/373; 123/374

[58] Field of Search ..... 123/140 R, 364, 373, 123/374; 279/1 S; 82/34 A, 34 B; 29/65; 408/14; 409/220

[56] References Cited

U.S. PATENT DOCUMENTS

| | | | |
|---|---|---|---|
| 2,771,297 | 11/1956 | Nipken | 279/1 S |
| 2,836,162 | 5/1958 | Dressler | 123/373 |
| 3,884,206 | 5/1975 | Ritter | 123/140 R |
| 3,915,139 | 10/1975 | Nishizawa | 123/140 R |
| 4,000,728 | 1/1977 | Kurokawa | 123/140 R |
| 4,148,290 | 4/1979 | Knorreck | 123/140 R |

FOREIGN PATENT DOCUMENTS 2311044 9/1974 Fed. Rep. of Germany ..... 123/140 R

*Primary Examiner*—Charles J. Myhre
*Assistant Examiner*—Carl Stuart Miller
*Attorney, Agent, or Firm*—Edwin E. Greigg

[57] ABSTRACT

A centrifugal rpm governor for internal combustion engines in which the initial stressing of an adaptation spring is adjustable in a continuously variable manner in the installed state and without changing the spring stroke (b) determining the adaptation path. The governor includes an adaptation device disposed in the force transmitting path between a control member which adjusts in accordance with rpm and a force transmitting member subject to the force of the governor spring, which adaptation device includes in a recessed longitudinal bore, a stop bolt and an adaptation spring supported at one end by a ring screwed onto a threaded portion of the stop bolt, the ring being guided for axial displacement and provided with rotational securing means in the longitudinal bore so that by rotating the stop bolt a variation of the initial stressing of the adaptation spring in a continuously variable manner is possible without affecting the preset spring stroke (b).

7 Claims, 3 Drawing Figures

CENTRIFUGAL RPM GOVERNOR FOR INTERNAL COMBUSTION ENGINES

BACKGROUND OF THE INVENTION

The invention relates to a centrifugal rpm governor of the type described herein and finally claimed. A centrifugal rpm governor of this design is already known (German Pat. No. 1,011,223), in which the adaptation device is placed in a force transmitting member such as a lever and through the initial stress of an adaptation spring determines the onset of adaptation and through the extent of projection of a stop bolt determines the adaptation stroke. In this adaptation device, in order to vary the onset of adaptation, the initial stress of the adaptation spring must be changed; however, this is only possible after disassembling the adaptation device and by the interposition of adaptation discs. Upon reinstalling the adaptation device, the extent of projection of the stop bolt which determines the adaptation stroke must be readjusted. A readjustment of this kind is very costly in time, and the variation in initial stressing of the adaptation spring can be undertaken only in stages because of the adaptation discs to be interposed.

It is also known from the above patent that the adaptation device comprises a spring capsule whose housing is formed as a threaded casing and screwed into a lever of the governor. Thus the adaptation device comprises a spring capsule ready for adjustment outside the governor. However, it also has the disadvantages already mentioned above, because this adaptation device permits neither continuously variable adjustment of the initial stressing force of the adaptation spring nor an adjustment of the initial stressing of the spring without influencing other settings of the governor, such as the adaptation stroke.

OBJECT AND SUMMARY OF THE INVENTION

The centrifugal rpm governor in accordance with the invention has the advantage over the prior art in that a continuously variable adjustment is possible of the initial stressing force of the adaptation spring which determines the onset of adaptation in the built-in adaptation device on the governor, without thereby changing the control paths set by the position and the stroke of the stop bolt. As a result, a more precise and rapid adjustment of the adaptation is attainable.

Advantageous further embodiments and improvements of the centrifugal rpm governor of the main claim are possible with the features described in the dependent claims. Thus, rotationally securing the ring which provides a support for the adaptation spring, in a manner which does not restrict the structural space available for the adaptation spring, is attainable in a simple manner; that is, the rotational securing of the ring comprises a nose protruding beyond its outer diameter and projecting into a longitudinal groove cut into the longitudinal bore and guided axially in that groove. A variation in the set initial stressing of the adaptation spring during operation is attained, without the use of additional elements which would restrict the available structural space, by means of the features of claims 3 and 4. By the features of claim 6 combined with those of the other claims, an adaptation device can be produced which is already set, with respect to the adaptation control stroke, outside the governor and which is formed as a spring capsule and in which the insertion depth of the spring capsule no longer affects the adaptation control stroke and further where the dimensions which determine the adaptation do not change, even with repeated disassembly and reinstallation.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
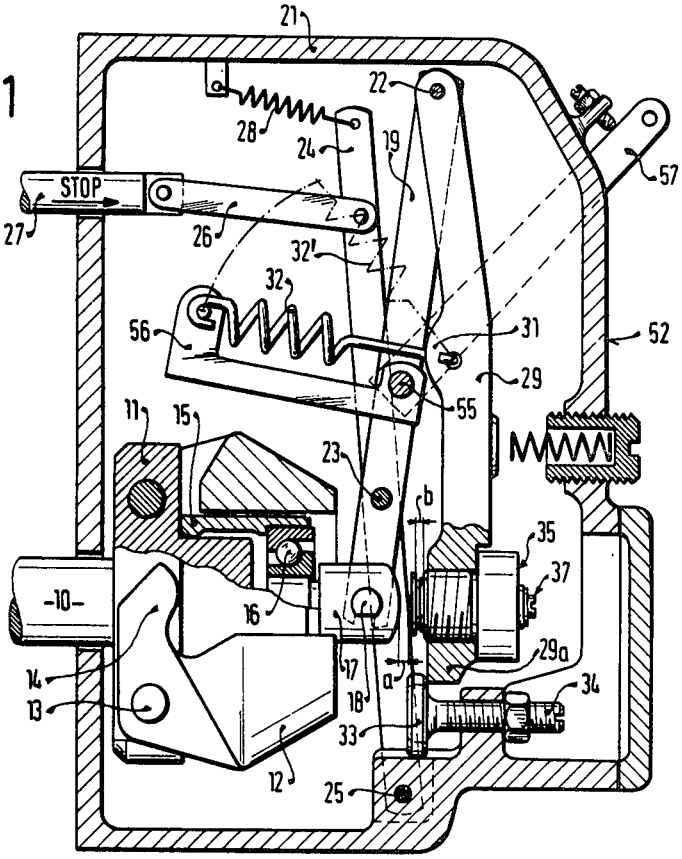
FIG. 1 shows a longitudinal cross-sectional view through a centrifugal rpm governor embodied in accordance with the invention having governor parts in the engine starting position.

Turning now to the drawings, a flyweight carrier 11 is secured on the camshaft 10 of a known injection pump, not shown in further detail, for use with an internal combustion engine with the flyweights 12 pivotably supported on the carrier 11 on bearing bolts 13. These flyweights 12, with pressure arms 14, engage a governor sleeve 15 which acts as the control member and which transmits the sleeve stroke effected by means of the flyweights 12 onto a sleeve bolt 17 by way of a pressure bearing 16. The sleeve bolt 17 is articulated by means of bearing elements 18 which are disposed on a guide lever 19, this lever being pivotable on a bearing pin 22 secured in the governor housing 21 and thus arranged to guide the governor sleeve 15 in its stroke movements. A pin 23 secured on the guide lever 19 serves as the pivotal bearing of a two-armed intermediate lever 24, the lower end of which is pivotably supported on a bearing pin 25 attached to the housing 21 and on the upper end of which, via a stub extension 26, the control rod 27 which acts as the supply quantity adjusting member of the injection pump is articulated. The stop direction of the control rod 27 is indicated by the arrow marked "STOP".

On the upper end of the intermediate lever 24, a play-compensating spring 28, which serves as the starting spring at the same time, is secured and suspended in the governor housing 21.

Besides the guide lever 19, a one-armed force lever 29 which functions as the force transmitting member is pivotably supported on the bearing pin 22 and is held in the illustrated position by the tension of a governor spring 32 which engages it in the region of a suspension eye 31. In this position, the lever 29 is pressed with its outermost end **29*a* against a head 33 of a stop screw 34** embodied as a cap screw and thus acts as the full-load stop.

At the level of the sleeve bolt 17, and adaptation device 35 is threaded into the force lever 29, and its stop bolt 37 which is loaded by an adaptation spring 36 cooperates with the sleeve bolt 17 of the governor sleeve 15 in order to control the adaptation.

In the illustrated starting position of the governor elements, in the position of rest of the flyweights 12 and the governor sleeve 15, the sleeve bolt 17 is at a predetermined distance "a" from the stop bolt 37 of the adaptation device 35, which distance is brought about by the initial stressing force of the starting spring 28, so that the control rod 27 is in a position which permits an increased starting quantity in excess of the full-load injection quantity.

Figure 2:
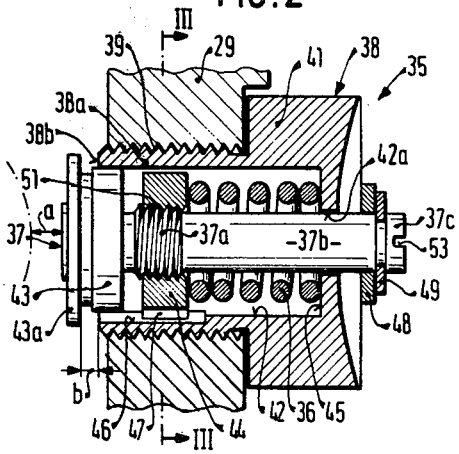
FIG. 2 shows a fragmentary cross-sectional view of a portion of FIG. 1 with the adaptation device shown on a larger scale.
Figure 3:
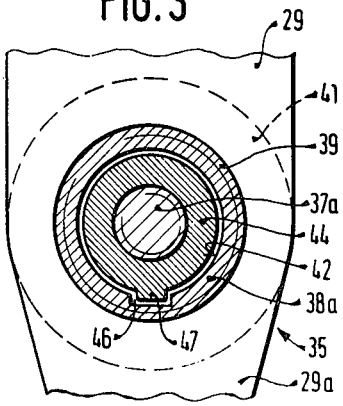
FIG. 3 is a sectional view taken along the line III—III of FIG. 2 in the direction of the arrows.

The adaptation device 35 provided in accordance with the invention with an apparatus for the adjustment of the initial stressing of the adaptation spring 36 will now be described in further detail with the aid of FIGS. 2 and 3, which are on a larger scale.

The adaptation device 35 which is embodied as a spring capsule has, as its housing, a threaded casing 38 which is screwed into the force transmitting lever 29. The threaded casing 38 being firmly screwed into the force transmitting lever 29 includes a sleeve element 38*a* the periphery of which is provided with the threaded area 39 and thus is arranged to contact the force transmitting lever 29 with a contact shoulder 41 that is enlarged with respect to part 38*a*. The sleeve element 38*a* of the threaded casing 38 which carries the threaded area 39 projects entirely through the lever 29 and beyond the opposite left wall thereof as viewed in the drawing. A recessed longitudinal bore 42 arranged in the threaded casing 38 encloses, in addition to the adaptation spring 36, the stop bolt 37 which is provided with a head 43. The bolt 37 has an area which is threaded as at 37*a*, on its shaft 37*b*, adjacent to the head 43, which threaded area 37*a* is provided with a ring 44 that is provided with an interior thread; and, as shown, this ring 44 has a shoulder which provides a support for the adaptation spring 36. In order to provide a second support for the adaptation spring 36, the recessed longitudinal bore 42 is provided with a step 45 which is formed by the difference in diameter between the bore 42 and a reduced-diameter bore portion 42*a* which guides the shaft 37*b* of the stop bolt 37.

The ring 44 has a nose 47 protruding beyond its outer diameter and projecting into a longitudinal groove 46 which is arranged in the longitudinal bore 42 and the nose 47 is thereby guided axially in that groove 46. This nose 47, together with the longitudinal groove 46, secures the ring 44 against rotation.

The installed length determining the initial stressing of the adaptation spring 36 is fixed by the distance between the step 45 in the longitudinal bore 42 and the ring 44, and the adaptation control stroke labelled "b" is thereby fixed by the installed position of the stop bolt 37. This installed length of the stop bolt 37 may be set by exchanging an adaptor disc 48 for a similar disc having a different thickness, and this disc 48 is supported, under the initial stressing force of the adaptation spring 36, on a securing ring 49 secured on the shaft 37*b*.

The threaded portion 37*a* of the stop bolt 37 is secured against self-adjustment opposite the interior threading of the ring 44 by a securing means 51 which effects automatic locking and thus is held in one position. In a preferred manner, a microencapsulated adhesive is introduced between the interior threading of the ring 44 and the threading of the threaded portion 37*a* which serves as a fluid securing means, making additional mechanical securing means superfluous and thus representing a favorable embodiment from the standpoint of conserving structural space.

In order to vary the initial stressing of the adaptation spring 36, the stop bolt 37 must be twisted. To this end, therefore, the stop bolt 37 carries, on its end 37*c* of the shaft 37*b* which is accessible from the front face 52 of the governor remote from the injection pump, an access point 53 in the form of a slot for a screwdriver serving as the adjusting tool.

The distance between a front face 38*b* of the threaded casing 38 which projects into the governor housing 21 and a section 43*a* of the head 43 having a larger diameter determines the adaptation control stroke "b", which the stop bolt 37 can perform, under the centrifugal force of the flyweights 12 transmitted by the sleeve bolt 17, against the restoring force of the adaptation spring 36. This stroke is fixed by the thickness of the adaptor disc 48 described above.

Now, if the stop bolt 37 is rotated in order to vary the initial stressing force of the adaptation spring 36, then the ring 44, secured against rotation by the nose 47 guided in the longitudinal groove 46, performs a change in position in the direction of the longitudinal axis of the stop bolt 37, as a result of which, depending upon the rotary direction of the stop bolt 37, the initial stressing force of the adaptation spring 36 is either increased or decreased. As a result of this variation in the initial stressing force, the onset and end of the adaptation control movement of the adaptation device 35 are shifted toward higher rpm in the case of increased initial stressing force of the adaptation spring 36, and toward lower rpm in the case of reduced initial stressing force. The adaptation control stroke, fixed by the extent of distance "b", and thus substantially the rpm difference as well, remains in force and is not affected by this variation in initial stressing; i.e., the difference in the control path covered by the control rod 27 in order to control the adaptation which is proportional to the adaptation control stroke retains the previously set value.

The governor spring 32 is prestressed in a known manner, via a pivoting lever 56 pivotally supported on a tang 55 in the governor housing 21 by means of a service lever 57 secured on the tang 55 and located outside the governor housing 21, into the illustrated position for the maximum rpm to be governed. The pivoted position of the governor spring 32 for governing an idling rpm is indicated by dot-dash lines at 32'.

The mode of operation of the centrifugal rpm governor constructed in accordance with the invention will now be described, with particular attention being directed to the control of adaptation.

In order to prepare for starting, the service lever 57 is pivoted, for example by the gas pedal (not shown), into its illustrated position for setting the maximal rpm to be governed and in which position the governor spring 32 is accordingly prestressed. By the force of the governor spring 32, the force lever 29 is moved with its end 29*a* against the head 33 of the full-load stop screw 34. The control rod 27 is in the position of rest of the flyweights 12, effected by the initial stressing force of the starting spring 28, in its position which controls the starting fuel quantity, and, between the stop bolt 37 of the adaptation device 35 and the sleeve bolt 17, there is the distance "a".

After starting and under the centrifugal force of the flyweights 12 which have swung outward, the governor sleeve 15 is displaced out of the position of the governor shown in FIG. 1 and toward the right moving the sleeve bolt 17 against the force of the starting spring 28 until it contacts the stop bolt 37. In so doing, the control rod 27 is retracted in a known manner to its full-load setting fixed for low rpm. The control rod 27 maintains this position until the rpm level is reached at which, in accordance with the initial stressing force of the adaptation spring 36, the stop bolt 37 begins to deviate and thus initiates the adaptation control movement. After the adaptation control stroke "b" has been covered, the adaptation control movement is ended, and the control rod 27 is in its full-load position which it maintains until the deregulation rpm level determined by the governor spring 32 is reached.

If the rpm level prevailing at the onset or end of adaptation does not correspond to the rpm set in the test specifications, then the stop bolt 37 can be rotated, even when the governor is in operation, by introducing an adjustment tool into the screwdriver slot 53 of the stop bolt 37 and the position of the ring 44, which determines the initial stressing force of the adaptation spring 36, can be varied until such time as the adaptation control movement begins or ends at the desired rpm.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A centrifugal rpm governor for internal combustion engines comprising, a control member which adjusts in accordance with rpm, at least one governor spring, a force transmitting member subject to the force of said at least one governor spring, an adaptation device disposed in the force transmitting path between said control member and said force transmitting member, said adaptation device having a longitudinal bore recessed to provide a step, a stop bolt having a head and a threaded portion disposed in said longitudinal bore, an adaptation spring in said longitudinal bore, said adaptation spring being supported at one end on said step in said longitudinal bore, an axially displaceable ring having a threaded interior secured to said stop bolt threaded portion adjacent said head and defining a shoulder for supporting the other end of said adaptation spring and means in said longitudinal bore for securing said ring against rotation.

2. A centrifugal rpm governor in accordance with claim 1, wherein said rotational securing means comprises a nose protruding beyond the outer periphery of said ring, said longitudinal bore being provided with a longitudinal groove into which said nose projects in axial sliding relationship therewith.

3. A centrifugal rpm governor in accordance with claim 1, including means for securing said stop bolt threaded portion opposite said ring threaded interior against self-adjustment to thereby provide automatic locking.

4. A centrifugal rpm governor in accordance with claim 3 wherein said means for securing said stop bolt threaded portion and said ring threaded interior comprises fluid securing means, such as a microencapsulated adhesive.

5. A centrifugal rpm governor in accordance with claim 1, wherein the internal combustion engine includes an injection pump, and wherein one end of said stop bolt is provided with an access point for engagement by an adjustment tool, said access point being accessible from the outside from the front face of the governor remote from the injection pump.

6. A centrifugal rpm governor having a lever provided with an internally threaded aperture and including an adaptation device comprising a spring capsule having a housing provided with a threaded casing, said threaded casing having a threaded portion screwed into said governor lever aperture, said threaded casing including a contact shoulder having a larger diameter than said threaded portion for firmly contacting said lever, said threaded portion extending through said lever and having a front face projecting into said governor, said adaptation device having a longitudinal bore, a stop bolt having a head provided with a section guidably disposed within said longitudinal bore, a ring attached to the stop bolt to prevent rotation of the guidably disposed section within the longitudinal bore, whereby the distance (b) between said front face and said stop bolt head section determines an adaptation control stroke.

7. A centrifugal rpm governor having a lever provided with an internally threaded aperture and including an adaptation device comprising a spring capsule having a housing provided with a threaded casing, said threaded casing having a threaded portion screwed into said governor lever aperture, said threaded casing including a contact shoulder having a larger diameter than said threaded portion for firmly contacting said lever, said threaded portion extending through said lever and having a front face projecting into said governor, said adaptation device having a longitudinal bore, a stop bolt having a head provided with a section guidably disposed within said longitudinal bore and having a threaded portion disposed in said longitudinal bore, an adaptation spring in said longitudinal bore, said adaptation spring being supported at one end on said step in said longitudinal bore, an axially displaceable ring having a threaded interior secured to said stop bolt threaded portion adjacent said head and defining a shoulder for supporting the other end of said adaptation spring and means in said longitudinal bore for securing said ring against rotation, whereby the distance (b) between said front face and said stop bolt head section determines an adaptation control stroke.

* * * * *